US005081933A

United States Patent [19]

Lapp et al.

[11] Patent Number: 5,081,933

[45] Date of Patent: Jan. 21, 1992

[54] LCTS CHASSIS CONFIGURATION WITH ARTICULATED CHASSIS SECTIONS BETWEEN VEHICLES

[75] Inventors: Steven P. Lapp; Peter E. Timan, both of Sydenham, Canada

[73] Assignee: UTDC Inc., Kingston, Canada

[21] Appl. No.: 494,220

[22] Filed: Mar. 15, 1990

[51] Int. Cl.[5] ..... B61D 17/00

[52] U.S. Cl. ..... 105/3; 105/168; 105/199.5; 280/426; 280/442

[58] Field of Search ..... 105/3, 165, 168, 171, 105/199.4, 199.5; 280/400, 426, 442

[56] References Cited

U.S. PATENT DOCUMENTS

| | | | |
|---|---|---|---|
| 2,115,095 | 4/1938 | Bugatti | 105/3 |
| 2,167,231 | 7/1939 | Blackmore | 105/3 X |
| 3,557,708 | 1/1971 | Bolte | 105/3 |
| 4,287,832 | 9/1981 | Kreissig et al. | 105/168 X |
| 4,337,705 | 7/1982 | Schellenburg | 105/168 |
| 4,860,666 | 8/1989 | Smith | 105/168 |

*Primary Examiner*—Robert J. Oberleitner
*Assistant Examiner*—S. Joseph Morano
*Attorney, Agent, or Firm*—Baker & Daniels

[57] ABSTRACT

A chassis for an articulated vehicle comprises a pair of chassis portions pivotally connected to a central longitudinal beam. The beam is supported by inboard wheelsets and the chassis portions are supported by outboard wheelsets. Each portion is hinged intermediate its ends to permit elevation of one end relative the other. A body is supported on the wheelsets.

12 Claims, 9 Drawing Sheets

LCTS CHASSIS CONFIGURATION WITH ARTICULATED CHASSIS SECTIONS BETWEEN VEHICLES

The present invention relates to articulated vehicles, and in particular to articulated vehicles suitable for use in mass transit applications.

The use of mass transit systems to move large numbers of people has increased dramatically and now finds use in relatively confined areas such as airports, theme parks and even shopping malls. The use of transit systems in these small areas requires the system to be able to accommodate small radius curves but still handle a relatively large number of people per trip. It is generally desirable, therefore, to utilize an articulated vehicle with a view to maintaining a reasonable capacity and yet accommodate the tight radiuses required.

Articulated passenger moving vehicles have been utilized in a number of applications such as streetcars but conventionally these vehicles are articulated about a relatively heavy centre section that accommodates the three degrees of freedom required at the centre of the vehicle. Such structures are suitable for heavy rail applications but their size and mass renders them unsuitable for lightweight rapid transit applications. These conventional centre structures also lead to a relatively high floor level that in turn raises the overall profile of the vehicle and requires special platforms for loading and unloading.

It is therefore an object of the present invention to provide a chassis suitable for an articulated vehicle in which the above disadvantages are obviated or mitigated.

According to the present invention, there is provided a chassis for an articulated vehicle comprising a pair of chassis sections placed end to end, a beam member extending between adjacent ends of said chassis sections, pivot means extending between said adjacent ends and said beam member to permit relative motion between said chassis sections about a vertical axis, a first pair of wheelsets supporting said beam at spaced locations and a second pair of wheelsets each of which is associated with a respective one of said chassis sections and located at the distal end thereof.

An embodiment of the present invention will now be described by way of example only with reference to the accompanying drawings in which:

FIG. 1 is a schematic representation of a side view of a vehicle;

FIGS. 2*a* and 2*b* are plane views of the chassis of the vehicle shown in FIG. 1 with the vehicle body shown in chain dot outline;

Figure 1:
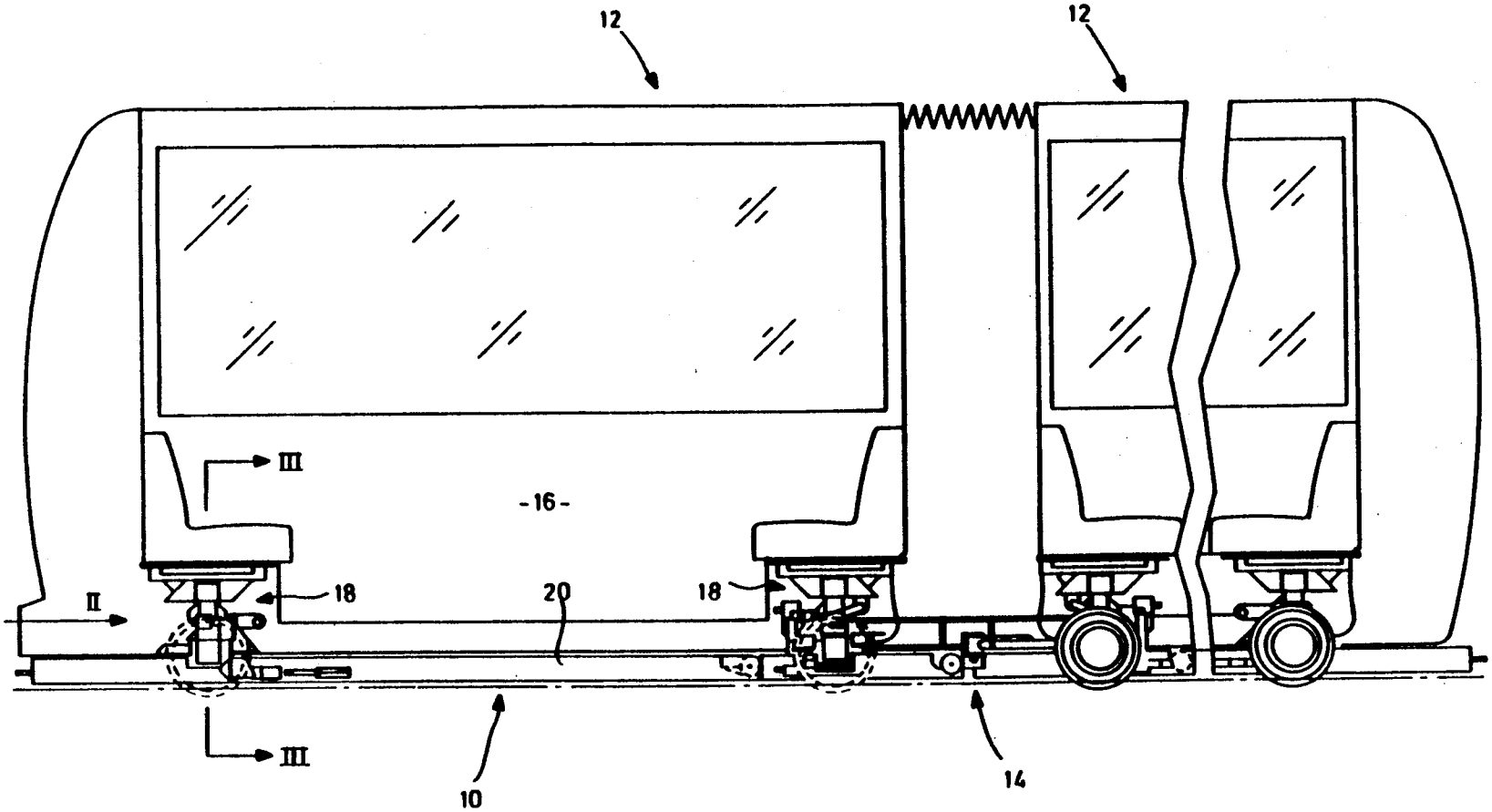

Referring therefore to FIG. 1, a transit vehicle 10 comprises a pair of bodies 12 supported on a chassis 14. The chassis 14 includes axle assemblies 16 that run on rails 18 with two axle assemblies supporting each body 12, one 16*a* at the outboard end and one 16*b* at the inboard end.

Each of the bodies 12 include a floor 20 having elevated end sections 22 on which are mounted seats 24 to provide a pair of oppositely directed benches in each body. The inboard end of the bodies 12 is interconnected by a bellows 26 that serves to seal the gap between the two bodies and prevent passengers entering between them.

Figure 3:
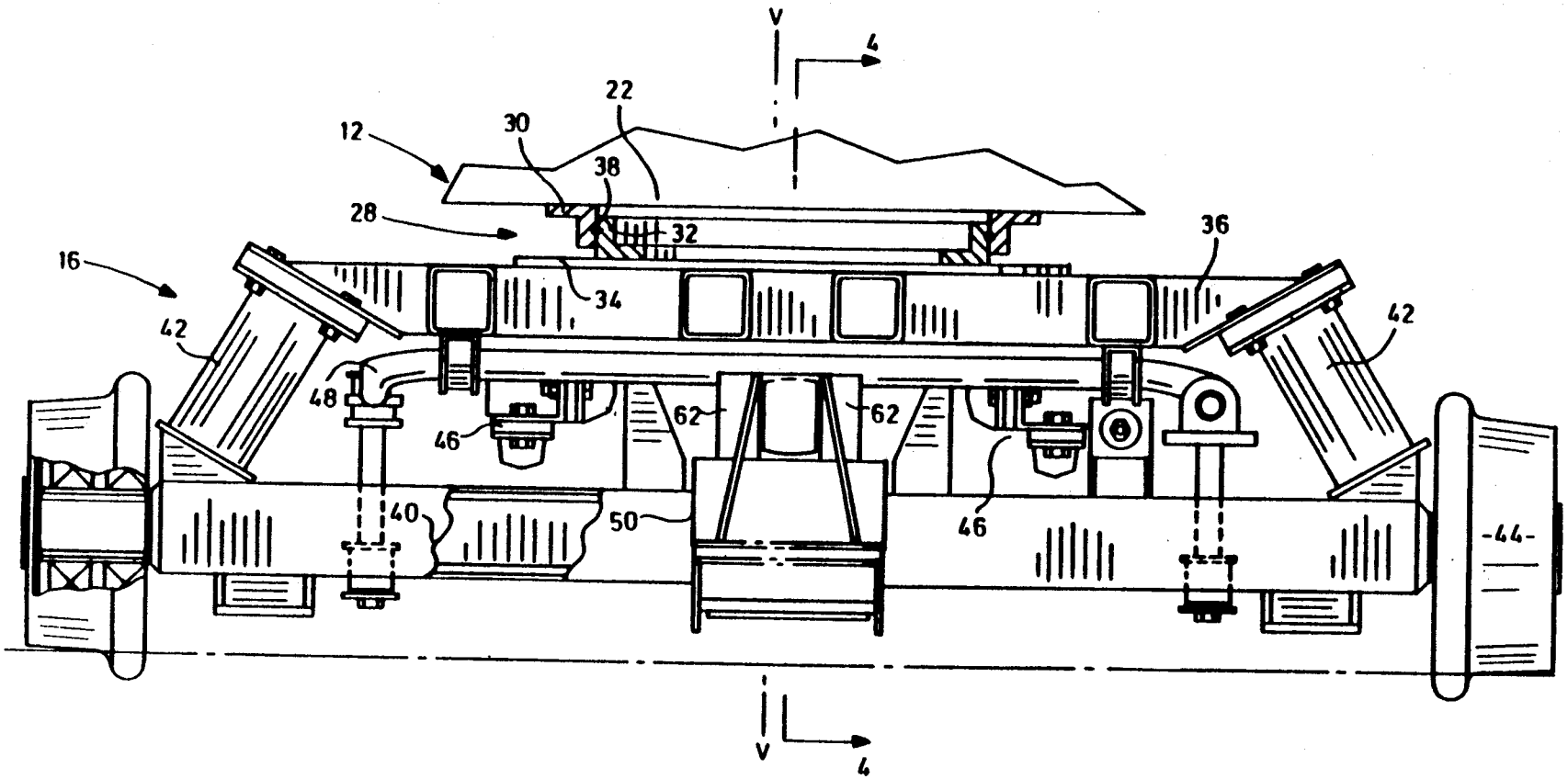
FIG. 3 is an end view of a portion of the chassis shown in FIG. 2.

The bodies 12 are connected to each of the axle assemblies 16 by means of a turntable 28 located within each of the elevated sections 22 of floor pan 20. As may best be seen in FIG. 3, each of the turntables 28 includes an outer race 30 connected to the floor pan 20 and an inner race 32 connected to a plate 34 mounted on top of a transverse support member 36. The races 30,32 are separated by a ball bearing 38 to allow rotation of the support 36 about an axis V—V.

Each axle assembly 16 further includes a transverse axle tube 40 maintained in spaced relationship from the support 36 by inclined elastomeric suspension elements 42. Wheels 44 are rotatably mounted at opposite ends of the axle tube 40 and interconnected by a torque tube 43 (FIG. 4) extending through the tube 42 in a manner described more fully in our co-pending U.S. application filed on even date herewith entitled "Wheelset for Rail Vehicle", and given Ser. No. 07/494,219 the contents of which are incorporated herein by reference. A drag link assembly 46 extends between the support 36 and tube 40 to maintain them in a common vertical plane and a torsion bar 48 acts between the support member and the tube to control roll of the body 16 relative to the axle tube 40.

Figure 4:
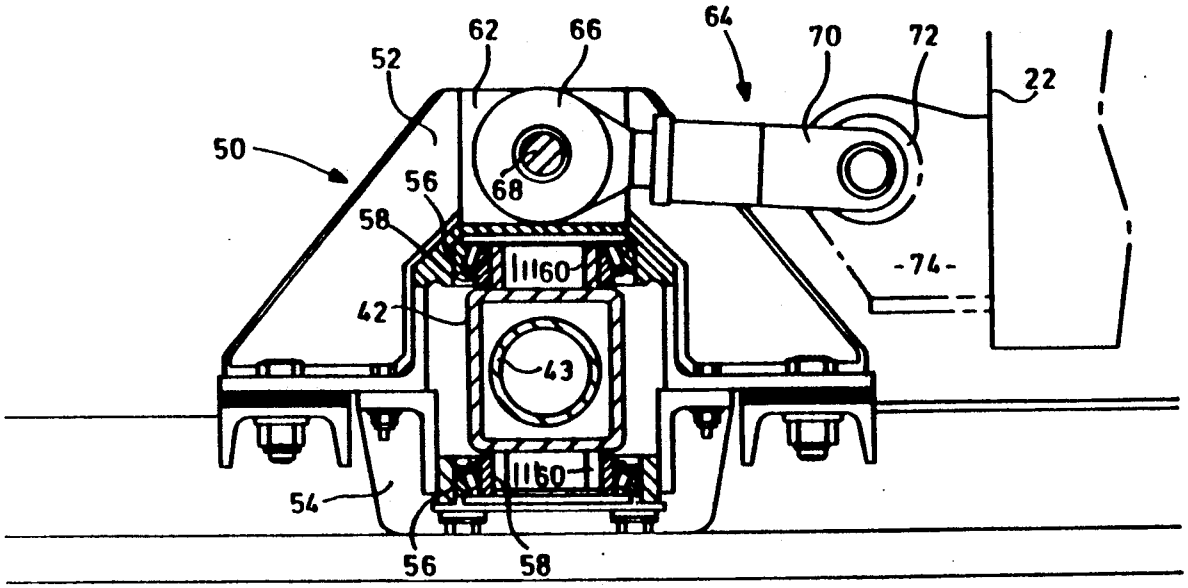
FIG. 4 is a view on the line 4—4 of FIG. 3.

The axle assemblies 16 located at the outboard end of the bodies 12 are pivotally connected to a collar 50 shown in more detail in FIG. 4. Collar 50 comprises upper and lower housings 52,54 respectively, each of which is bored as indicated at 56 to receive a roller bearing 58. Cylindrical projections 60 extend from upper and lower surfaces of the tube 40 to be received in the bearings 58 and allow pivotal movement of the tube relative to the collar 50 about the axis V—V. Upper housing 52 also includes a pair of ears 62 between which a link 64 having a ball joint 66 is secured by a pin 68. Link 64 has a clevis 70 at its opposite end to pass about a ball joint 72 mounted in a bracket 74. The bracket 74 is attached to the well 22 of floor pan 20 so that link 64 serves to transfer longitudinal loads between the axle assemblies and the bodies 12.

Chassis 14 includes a pair of chassis sections 73,75 each having an outboard portion 77 and an inboard portion 79. The chassis sections 73,75 are substantially identical in construction and therefore only one will be described in detail.

The collar assembly 50 is secured to the outboard portion 77 between a pair of elongate frame members 76 having a generally Z-shaped cross section. The frame members 76 are maintained in spaced relation by transoms 78 and outriggers 80 extend to one side of the frame members 76 to support a supply duct 82. The frame members 76 extend beyond the axle assembly 16 at the outboard end and terminate in a towing hitch 84 that permits connection to another vehicle 10.

Figure 8:
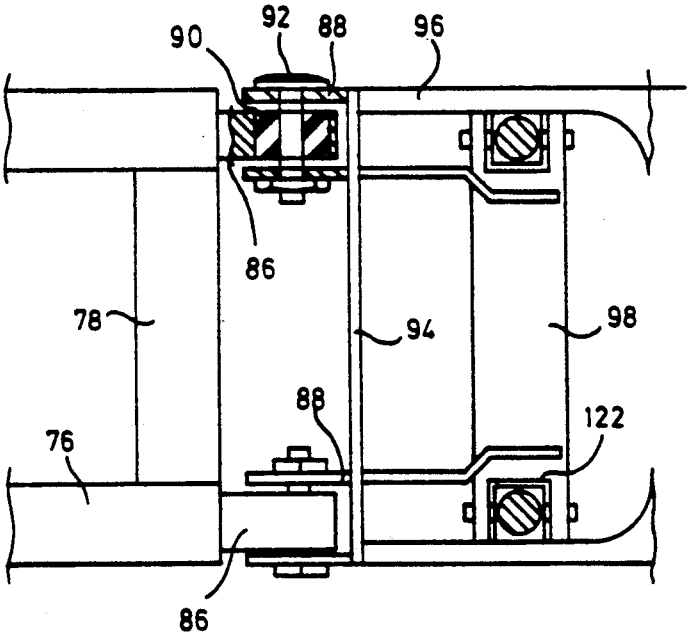
FIG. 8 is a view on the line 8—8 of FIG. 7.
Figure 9:
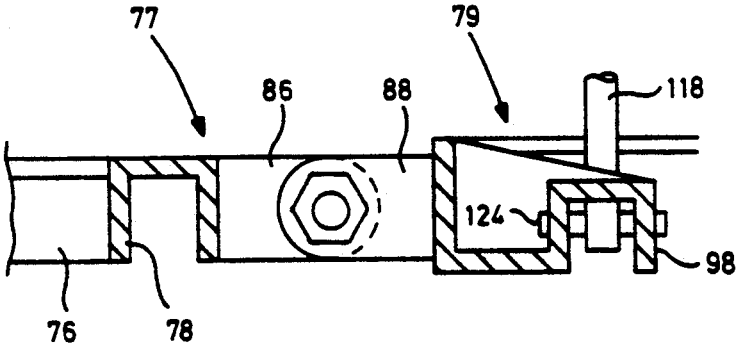
FIG. 9 is a view on the line 9—9 of FIG. 8.

As shown in FIGS. 6–9, the inboard end of the frame members 76 terminates in a pair of spaced cylindrical bosses 86 that are received between the arms of a clevis 88 as shown more fully in FIG. 8. The bosses 86 include an elastomeric bushing 90 through which a bolt 92 passes to provide a horizontal pivot axis between the portions 77, 79.

The clevis 88 is formed on an end plate 94 that extends between longitudinal frame members 96 forming the inboard portion 79. Frame members 96 are maintained in spaced relationship by transoms 98 and the frame members 96 terminate in a pair of inwardly convergent ears 100 which pass to either side of a ball joint 102 and are secured thereto by means of a pin 104. Ball joint 102 is mounted in a bracket 106 depending from the underside of a longitudinal beam 108. The ball joint 102 thus permits universal movement of the chassis section 73 relative to the beam 108.

The beam 108 is undercut at 110 to receive a collar assembly 112 similar in configuration to collar assembly 50. Collar assembly 112 supports the axle tube 40 of the inboard axle assembly 16 for rotation about a vertical axis so that the inboard axle 16 supports the beam 108 at spaced locations on opposite sides of the centre line of the vehicle 10.

A hanger assembly 114 is provided at the outboard end of beam 108 to support the outboard end of the inboard section 79 of the chassis section 73,75. Hanger 114 includes a transverse beam 116 (FIG. 7) from which depend a pair of vertical links 118. The links 118 are secured to the beam 116 by pins 120 so that the links 118 may move about a longitudinal horizontal axis relative to the beam 116. Lower end of links 118 pass through apertures 122 (FIG. 8) in transom 98 and are secured by pins 124 extending between opposite walls of the transom 98. Links 118 thus permit lateral movement of the inboard chassis section 79 relative to the beam 108.

Figure 2A:
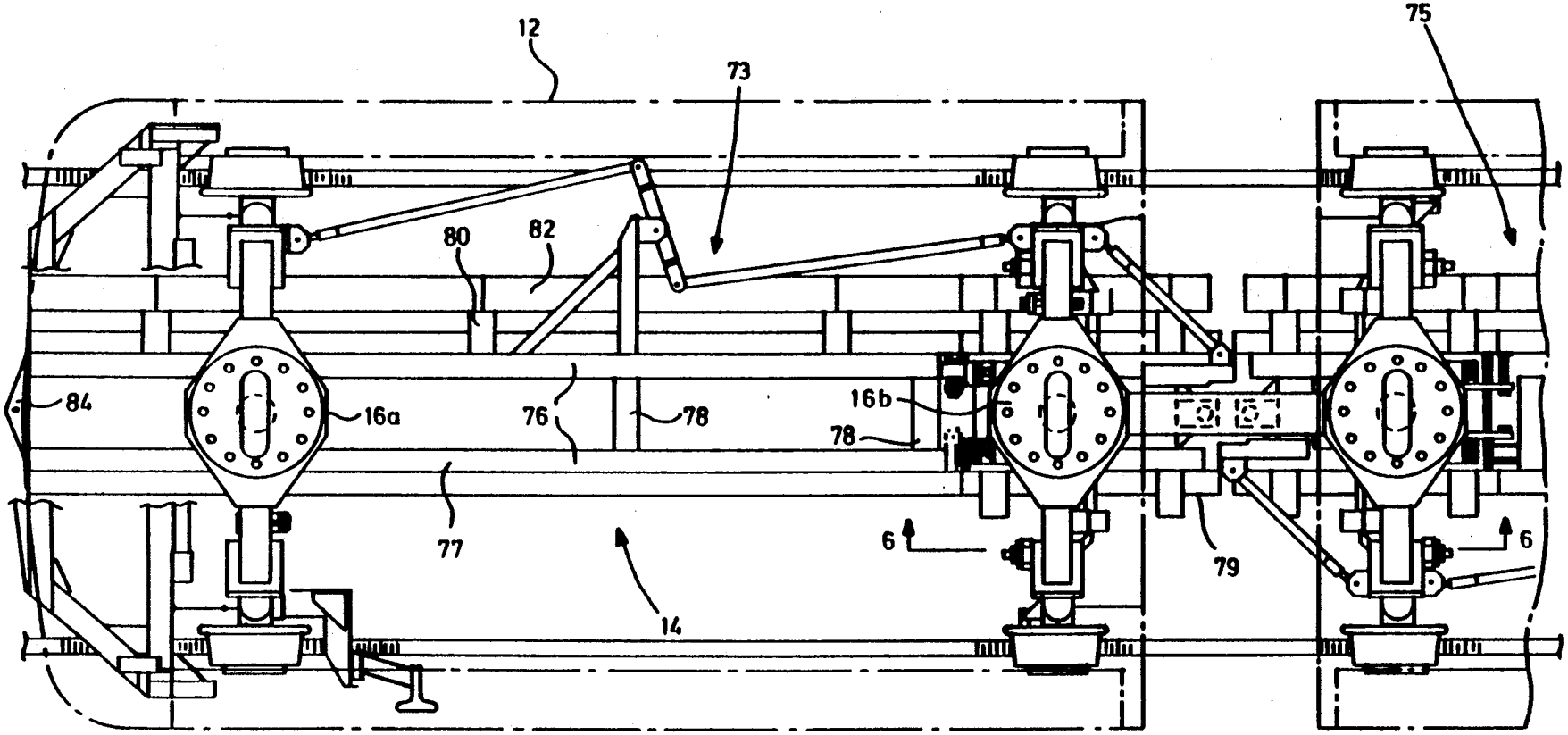
Figure 2B:
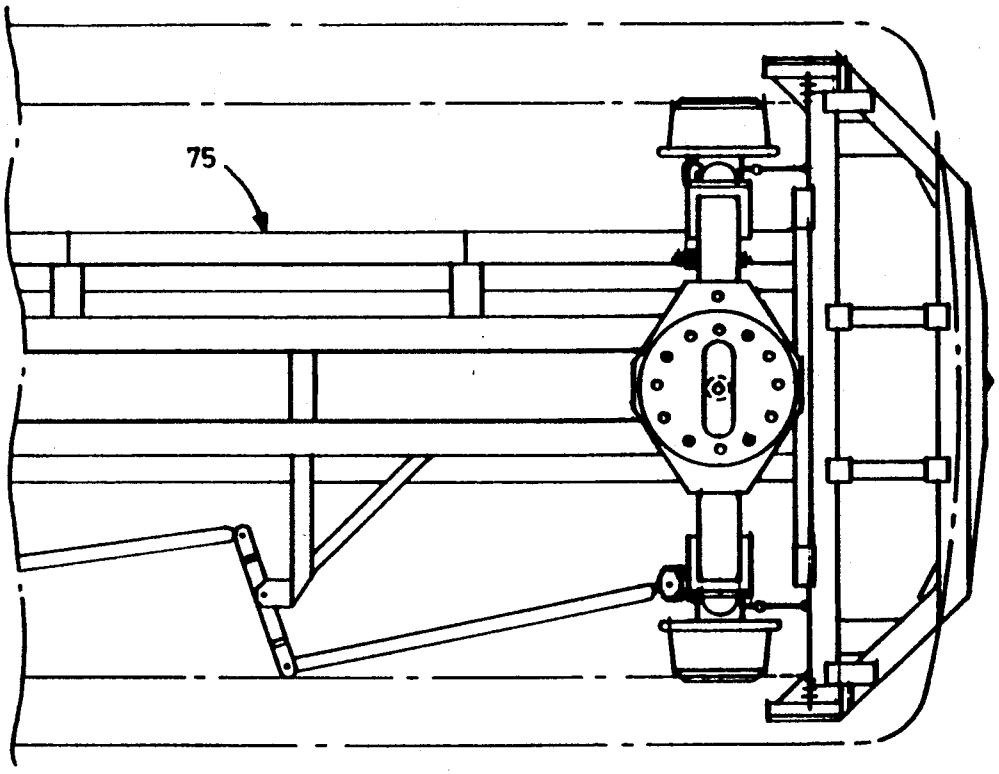
Figure 5:
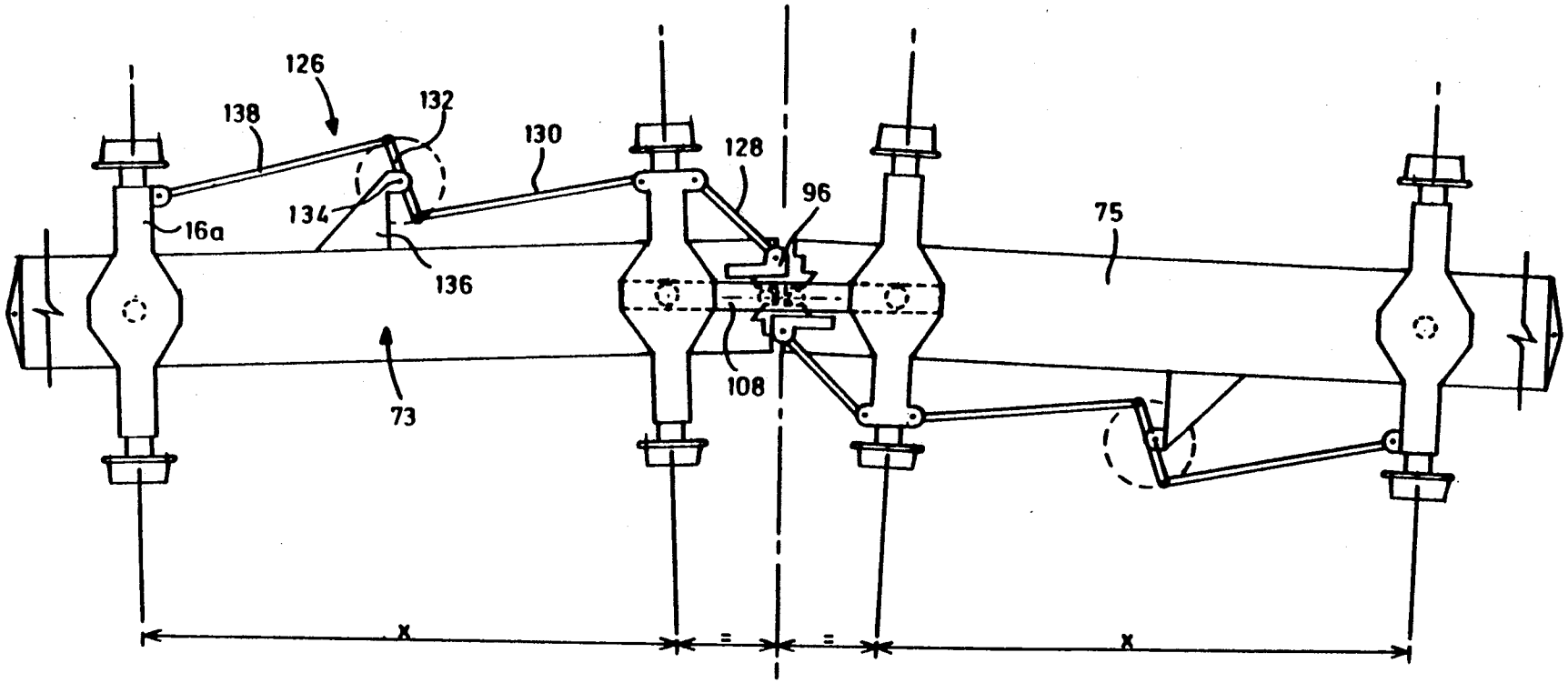
FIG. 5 is a schematic plan view showing the components of the chassis in a curve.
Figure 6:
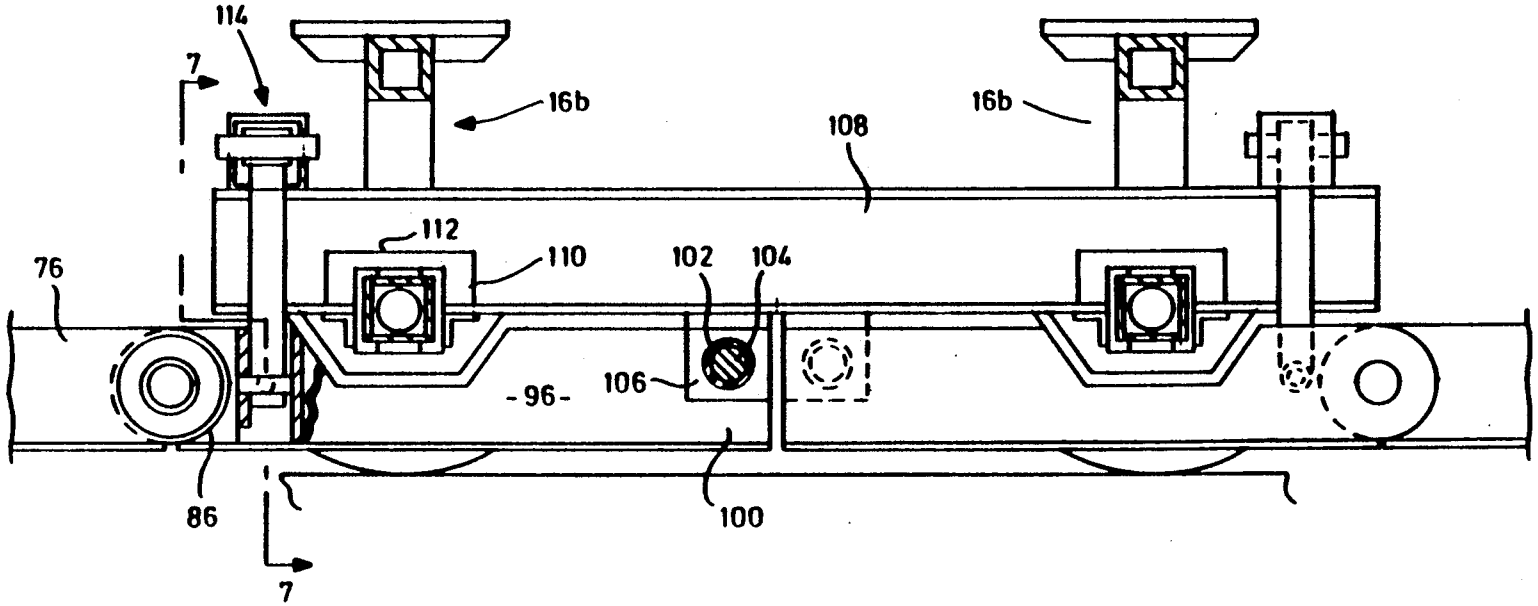
FIG. 6 is a side view partly in section taken on the line 6—6 of FIG. 2.
Figure 7:
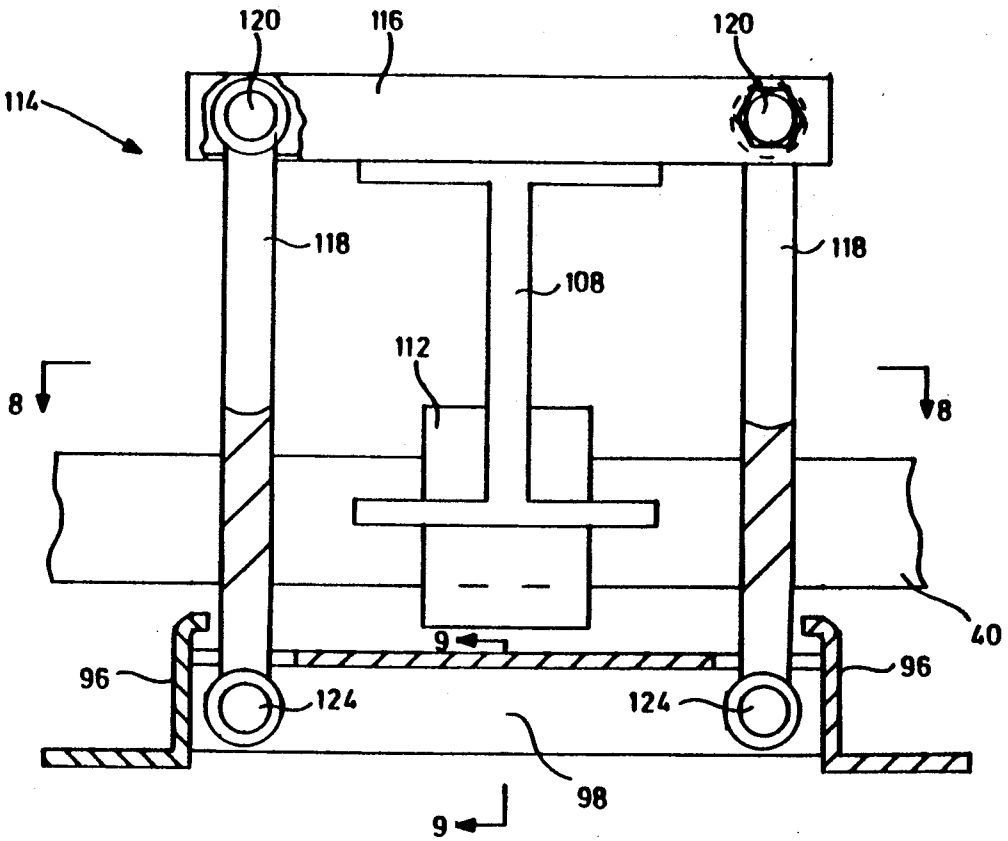
FIG. 7 is a view on the line 7—7 of FIG. 6.

The orientation of the axle assembly 16 relative to the vehicle body is controlled through a steering linkage indicated generally at 126 in FIGS. 2 and 5. Steering linkage 126 includes a first link 128 extending from the inboard end of the frame member 96 to the inboard axle assembly 16. A second link 130 extends to a lever 132 that is fulcrumed by a pin 134 to an outrigger 136 secured to the outboard section 77. A third link 138 extends from the lever 132 to the outboard axle assembly 16.

In operation, the vehicle body 12 is supported on the chassis 14 through the elastomeric suspension elements 42. Vertical loads are taken through the turntable 28 into the floor pan 20 with longitudinal loads transmitted through the link 64. The axles 16 are maintained in spaced relationship beneath the body 12 by the chassis sections 73,75 and elevation of one end of the chassis section relative to the other is accommodated through the horizontal pivot axis provided by the bolts 92 acting between the clevises 88 and bosses 86. The inboard end of the chassis section 73,75 is supported on the universal joints 102 by the beam 108 which is itself supported by the inboard axle assemblies 16. The chassis sections are thus free to articulate relative to one another about the centre line of the vehicle and to accommodate changes in elevation by virtue of the bolts 92. Pitch of one axle 16 relative to the others is accommodated by the ball joint 102 which allows tilting of one chassis section relative to the beam 108.

The accommodation of tight curves is provided by the steerable axles which are maintained in radial orientation by the steering linkage 126. Upon the outboard end of one of the chassis sections 73,75 entering a curve, a lateral displacement occurs of that end of the chassis. The chassis section 73 thus rotates about the vertical axis defined by the ball joint 102 and is displaced laterally relative to the axis of rotation of the axle assembly 16 on the beam 108. The hanger assembly 114 permits the limited displacement necessary to accommodate the curve. This displacement is produced by rotation of the inboard axle 16*b* relative to the beam 108 as induced by the first link 128 and corresponding movement through the second link 130, lever 132 and third link 134 to the outboard axle 16*a*.

It will be appreciated, of course, that alternative steering systems might be utilized with the axle assembly 16.

The use of the beam 108 to support the inboard axle assemblies, interconnect the two bodies and provide support for the chassis sections 73,75 results in a very compact lightweight articulation joint within a relatively low profile. Chassis sections 73,74 may conveniently be used to support the secondary of a linear induction motor permitting propulsion of thee transit vehicle 10 by primaries embedded within the track Suitable secondaries are assured in our co-pending U.S. application filed on Nov. 8, 1989 and issued U.S. Ser. No. 432,999 in more complete detail.

We claim:

1. A chassis for an articulated vehicle comprising a pair of chassis sections each having a hinge intermediate its ends to connect inboard and outboard portions of said chassis section for pivotal movement about a transverse horizontal axis, a beam member extending between adjacent inboard portions of said chassis sections and supported at spaced locations by a first pair of wheelsets, pivot means connecting each of said inboard portions of said chassis sections to said beam at a substantially common location intermediate said first pair of wheelsets to permit limited universal pivotal movement between said beam and chassis sections, a second pair of wheelsets each of which is associated with a respective one of said outboard portions of said chassis sections and located at the distal end thereof, and support means extending from said beam to the inboard portion of each chassis section to locate said inboard portion vertically relative to said beam.

2. A chassis according to claim 1 wherein each of said wheel sets is rotatable about a vertical steering axis.

3. A chassis according to claim 2 wherein steering link means extend between said wheelsets to constrain said wheelsets to adopt a radial position upon negotiation of a curve.

4. A chassis according to claim 3 wherein said pivot means are located between and spaced from each of said first pair of wheelsets and said wheelsets rotate about vertical axes spaced from said pivot means.

5. A chassis according to claim 4 wherein said steering link means includes a first pair of links connected to said chassis section adjacent said pivot means and each extending to a respective one of said wheelsets of said first pair of wheelsets at a location spaced from the vertical axis of rotation thereof, whereby lateral displacement of said chassis section relative to said beam member induces rotation of said wheelset about its vertical steering axis.

6. A chassis according to claim 5 wherein said steering link means includes a second linkage extending between said one of said first pair of wheelsets and said other pair of wheelsets to induce a proportional rotation thereof to produce a radial position for said wheelset.

7. A chassis according to claim 1 wherein said beam member is located above said chassis sections and said support means depends from said beam member.

8. A chassis according to claim 7 wherein said support means includes a linkage to accommodate limited lateral movement of said chassis section relative to said beam member.

9. A chassis according to claim 8 wherein said support means includes a pair of laterally spaced links each pivotally connected at opposite ends to said beam and said chassis section to accommodate said relative lateral movement.

10. A chassis according to claim 9 wherein said pivot means are located on the opposite side of said wheelsets to said support means.

11. A chassis according to claim 10 wherein said beam member is a single beam centrally located and said link means are connected to an outrigger extending to opposite sides of said beam.

12. A chassis according to claim 10 wherein said hinge is located adjacent said support means.

* * * * *